US006815622B2

(12) United States Patent
Milman et al.

(10) Patent No.: US 6,815,622 B2
(45) Date of Patent: Nov. 9, 2004

(54) METHODS AND APPARATUS FOR AUTOMATICALLY TRANSFERRING ELECTRICAL POWER

(75) Inventors: Sheldon Milman, Wheeling, IL (US); Mark A. Serrano, Chicago, IL (US)

(73) Assignee: General Electric Company, Schenectady, NY (US)

( * ) Notice: Subject to any disclaimer, the term of this patent is extended or adjusted under 35 U.S.C. 154(b) by 457 days.

(21) Appl. No.: 09/681,281

(22) Filed: Mar. 13, 2001

(65) Prior Publication Data

US 2002/0130023 A1 Sep. 19, 2002

(51) Int. Cl.[7] ..... H01H 9/26; H01H 3/16

(52) U.S. Cl. ..... 200/5 R; 200/47; 335/11; 335/13

(58) Field of Search ..... 335/6, 11, 13; 200/5 R, 47, 18

(56) References Cited

U.S. PATENT DOCUMENTS 4,672,227 A 6/1987 Lagree et al.
4,747,061 A 5/1988 Lagree et al.
4,894,796 A 1/1990 Engel et al.
5,070,252 A 12/1991 Castenschiold et al.
5,652,416 A * 7/1997 Sharaf et al. ..... 200/5 R
5,734,239 A 3/1998 Turner
5,739,594 A 4/1998 Sheppard et al.
5,914,467 A 6/1999 Jonas et al.
5,939,799 A 8/1999 Weinstein
5,939,802 A 8/1999 Hornbeck
6,172,432 B1 1/2001 Schnackenberg et al.
6,184,593 B1 2/2001 Jungreis
6,239,513 B1 5/2001 Dean et al.

* cited by examiner

*Primary Examiner*—Ramon M. Barrera
(74) *Attorney, Agent, or Firm*—Armstrong Teasdale LLP

(57) ABSTRACT

An automatic transfer switch includes a main body having a solenoid side and an auxiliary side. A solenoid side limit switch assembly is mounted to the solenoid side and an auxiliary side limit switch assembly is mounted on the auxiliary side. The solenoid side limit switch assembly includes a plurality of limit switches and a solenoid side mounting plate. The auxiliary side limit switch assembly includes a plurality of limit switches and an auxiliary side mounting plate.

23 Claims, 4 Drawing Sheets

METHODS AND APPARATUS FOR AUTOMATICALLY TRANSFERRING ELECTRICAL POWER

BACKGROUND OF INVENTION

This invention relates generally to electrical power transfer and, more particularly, to automatic transfer switches.

An automatic transfer switch provides a continuous source of power for critical loads by automatically transferring from a normal power source to an emergency power source when the normal power source falls below a preset limit. Automatic transfer switches are in widespread use in hospitals, military installations, industrial sites, and commercial buildings where even brief power interruptions can be costly. Automatic transfer switches are also common to the power industry. Typical automatic transfer switches include a plurality of mechanical switching components controlled to minimize any interruptions during switching operations. Control of the switching components occurs through a series of sensing relays, transformers, and actuators, such as solenoids or linear motors to facilitate timely transfer from normal to emergency power. The solenoid actuators are energized until the controller senses that the switching component has moved to its desired position. Typically, a plurality of limit switches are positioned to provide a signal to the controller that switching is complete. Proper alignment of the limit switches facilitates a longer lasting automatic transfer switch because when the solenoid is energized, but the limit switch fails to actuate because of misalignment, the solenoid will be energized for a prolonged period of time which may damage the solenoid. Additionally, the limit switches, typically, are adjusted during assembly and/or installation resulting in an expenditure of time and raising assembly and/or installation costs.

Accordingly, it would be desirable to provide a cost-effective automatic transfer switch that is easy to assemble and install and facilitates a proper alignment of the limit switches and the switching components without adjustment during assembly and installation.

SUMMARY OF INVENTION

An automatic transfer switch includes a main body having a solenoid side and an auxiliary side. A solenoid side limit switch assembly is mounted to the solenoid side and an auxiliary side limit switch assembly is mounted on the auxiliary side. The solenoid side limit switch assembly includes a plurality of limit switches and a solenoid side mounting plate. The auxiliary side limit switch assembly includes a plurality of limit switches and an auxiliary side mounting plate. A unitary arc chute cover plate covers a plurality of phase plates.

The limit switches are in fixed relationship to the mounting plates and assembly time is decreased because the limit switches are not adjusted during assembly. Additionally the unitary construction of the arc chute cover plate facilitates a reduction in assembly time versus an automatic transfer switch having a plurality of separate cover plates. The automatic transfer switch facilitates a decrease in assembly time by utilizing a pre-assembled auxiliary limit switch assembly, a pre-assembled solenoid side limit switch assembly, and a unitary construction. The limit switches are not adjusted during assembly and installation providing for easy assembly and installation. Additionally, a tabbed mounting plate provides for easy mounting of the automatic transfer switch to an enclosure facilitating a decrease in installation time. Accordingly, an easy to assemble and install automatic transfer switch that is cost-effective is provided.

DETAILED DESCRIPTION

Figure 1:
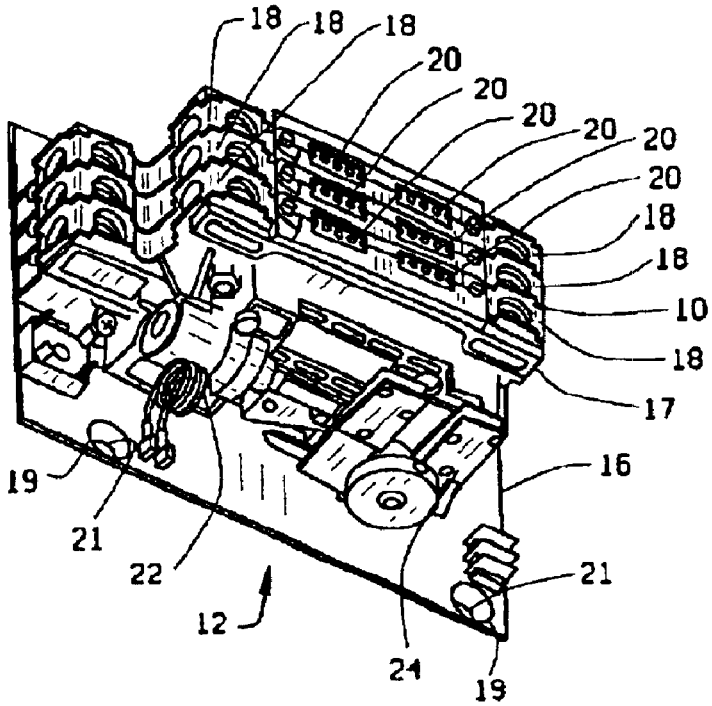
FIG. 1 is a perspective view of one embodiment of an automatic transfer switch.
Figure 2:
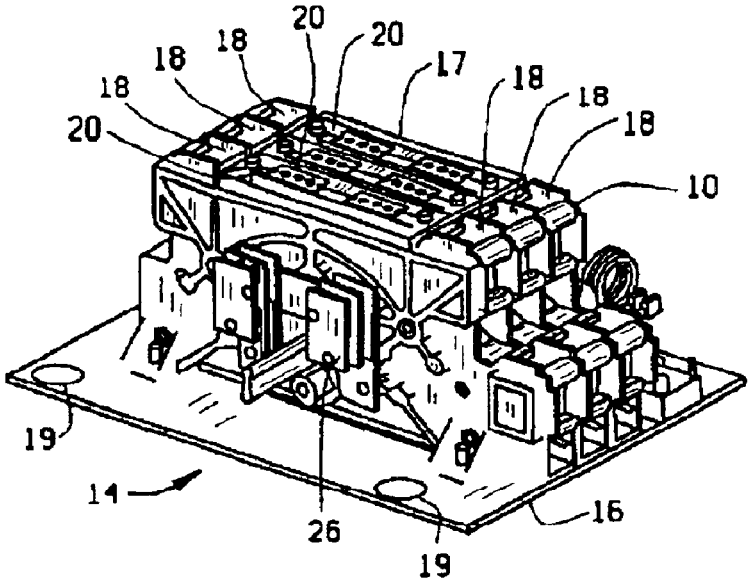
FIG. 2 is a perspective view of the automatic transfer switch shown in FIG. 1.

FIG. 1 is a perspective view of one embodiment of an automatic transfer switch 10 including a solenoid side 12 and FIG. 2 is a perspective view of transfer switch 10 illustrating an auxiliary side 14 of transfer switch 10. Transfer switch 10 is mounted to a mounting plate 16 and includes a main body 17 including a plurality of bus assemblies 18 electrically connected to a plurality of phase plates 20. Mounting plate 16 includes a plurality of mounting depressions 19 each including a mounting opening 21 substantially centered therein. Mounting depressions 19 are generally semispherically shaped. On solenoid side 12, transfer switch 10 includes a solenoid 22 and a solenoid side limit switch assembly 24. On auxiliary side 14, transfer switch 10 includes an auxiliary side limit switch assembly 26.

Figure 3:
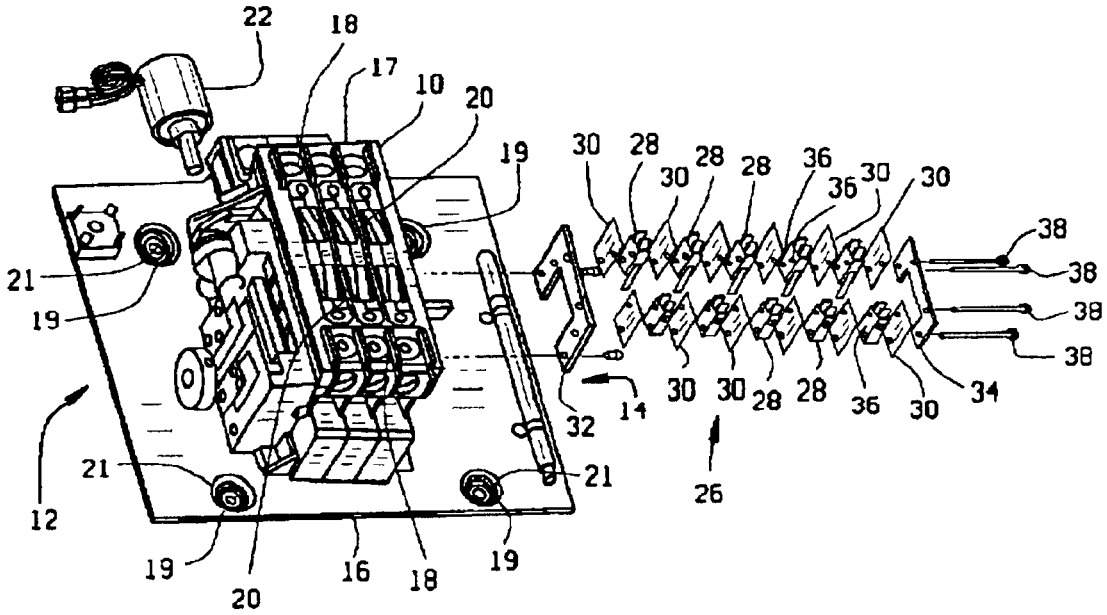
FIG. 3 is a partially exploded view of the automatic transfer switch shown in FIG. 1.

FIG. 3 is a partially exploded view of transfer switch 10. Auxiliary side limit switch assembly 26 includes a plurality of limit switches 28 interspersed with a plurality of spacers 30. In an exemplary embodiment, auxiliary side limit switch assembly includes ten limit switches 28, twelve spacers 30, an auxiliary side mounting plate 32, and an auxiliary side end plate 34. In an exemplary embodiment, spacers 30 are fabricated from a flame resistant polypropylene, such as, for example, 30,000 Formax, commercially available from Absolute Industrial Fabricators, Adison II. Limit switches 28 are oriented substantially perpendicular to mounting plate 16 and are arranged in coplanar pairs with three pairs internal to main body 17 and two pairs external to main body 17. In an exemplary embodiment, auxiliary side mounting plate 32 is fabricated from nickel-plated ⅛ inch thick cold rolled steel and auxiliary side end plate 34 is fabricated from 0.052 inch thick galvanized steel.

During assembly of transfer switch 10, auxiliary side limit switch assembly 26 is assembled and mounted to transfer switch 10 utilizing auxiliary side mounting plate 32. Each switch 28 includes a plurality of mounting openings 36. Inserting a plurality of mounting rods 38 through end plate 34, spacers 30, switches 28, and auxiliary side mounting plate 32 positions switches 28 in a fixed relationship with auxiliary side mounting plate 32 which facilitates assembly of transfer switch 10 without adjustment of switches 28. The fixed relationship of switches 28 with mounting plate 32 also facilitates a perpendicular orientation of switches 28 to mounting plate 16. In an exemplary embodiment, mounting rods 38 are threaded and threadably engage transfer switch 10.

Figure 4:
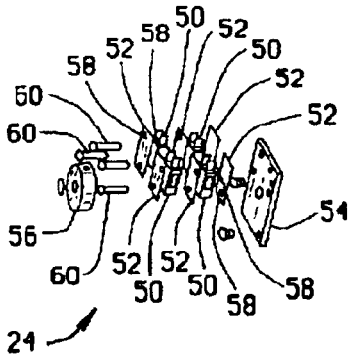
FIG. 4 is an exploded view of a solenoid side limit switch assembly shown in FIGS. 1.

FIG. 4 is an exploded view of solenoid side limit switch assembly 24 (shown in FIGS. 1–3) including a plurality of limit switches 50 interspersed with a plurality of spacers 52. In one embodiment, solenoid side limit switch assembly 24 includes four limit switches 50, six spacers 52, a solenoid side mounting plate 54, and a manual switch knob 56. Limit switches 50 are oriented substantially perpendicular to mounting plate 16 and are arranged in coplanar pairs external to main body 17.

During assembly of transfer switch 10, solenoid side limit switch assembly 24 is assembled and mounted to transfer switch 10 utilizing solenoid side mounting plate 54. Each switch 50 includes a plurality of mounting openings 58. Inserting a plurality of mounting rods 60 through spacers 52, switches 50, and solenoid side mounting plate 54 positions switches 50 in a fixed relationship with solenoid side mounting plate 54 which facilitates assembly of transfer switch 10 without adjustment of switches 50. The fixed relationship of switches 50 with solenoid side mounting plate 54 also facilitates a perpendicular orientation of switches 50 to mounting plate 16. In one exemplary embodiment, mounting rods 60 are threaded and threadably engage transfer switch 10. In an alternative exemplary embodiment, transfer switch 10 is molded and includes a unitary molded pocket sized to receive solenoid side mounting plate 54 which decreases assembly time and facilitates a perpendicular alignment between switches 50 and mounting plate 16. In a further alternative embodiment, transfer switch 10 includes a plurality of unitarily molded pockets to accept solenoid 22 and other accessories. Auxiliary side limit switch assembly 26 and solenoid side limit switch assembly 24 are mounted separately to mounting plate 16 prior to main body 17 being mounted to mounting plate 16.

During operation, transfer switch 10 provides a continuous source of power for critical loads by automatically transferring from a normal power source to an emergency power source when the normal power source falls below preset limits. Transfer switch 10 is rated for between 30 amperes and 225 amperes.

Figure 5:
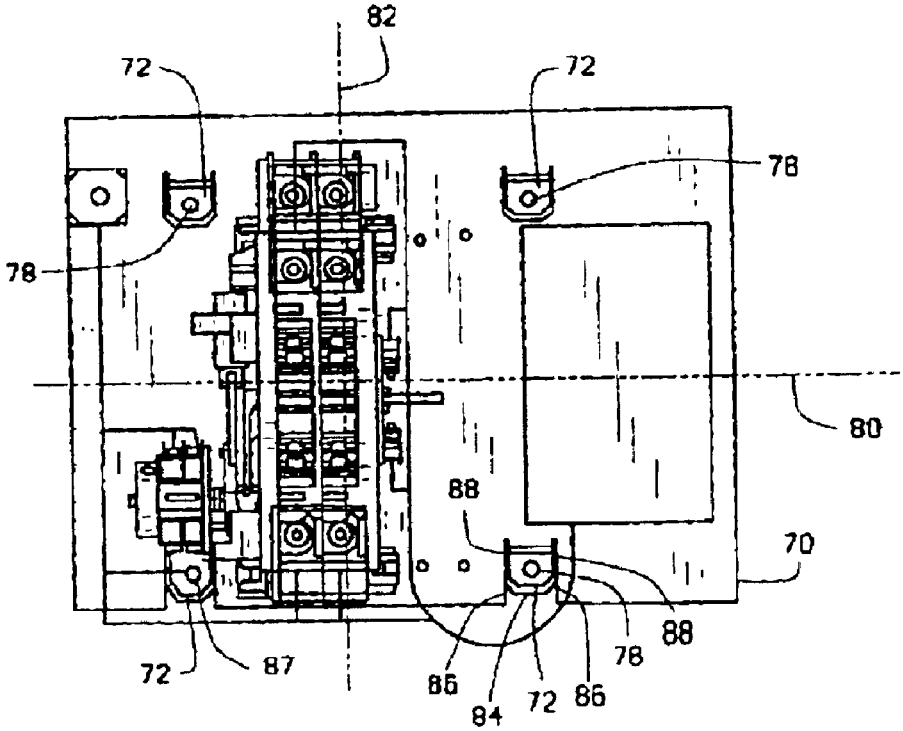
FIG. 5 is a top view of the automatic transfer switch shown in FIG. 1 mounted on a tabbed mounting plate.
Figure 6:
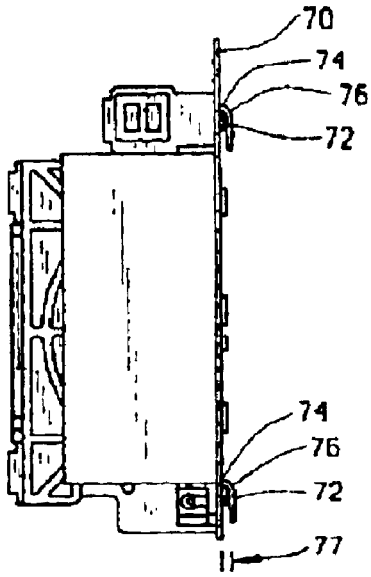
FIG. 6 is a side view of the automatic transfer switch shown in FIG. 1 mounted on the tabbed mounting plate shown in FIG. 5.

FIG. 5 is a top view and FIG. 6 is a side view of transfer switch 10 (shown in FIGS. 1–4) mounted on a tabbed mounting plate 70 including a plurality of attachment tabs 72 extending from tabbed mounting plate 70. Each attachment tab 72 is unitary with tabbed mounting plate 70 and each tab 72 extends obliquely from a first bend 74. Each tab 72 includes a second bend 76 after which each attachment tab 72 extends substantially parallel to tabbed mounting plate 70 defining a width 77 corresponding to a width of an enclosure (not shown). In one embodiment, mounting plate 70 is fabricated from sheet steel and attachment tabs 72 are formed with a punch press in a single operation. In an alternative embodiment, attachment tabs 72 are not unitary with tabbed mounting plate 70. Rather, attachment tabs 72 are fabricated separate from tabbed mounting plate 70 and are attached according to conventional methods. The enclosure includes a plurality of debossed tabs sized and positioned to receive attachment tabs 72. In an exemplary embodiment, each attachment tab 72 includes at least one mounting opening 78 substantially centered thereon to facilitate attaching tabbed mounting plate 70 to an enclosure having mounting studs instead of debossed tabs. Tabbed mounting plate 70 can be mounted to an enclosure having embossed tabs utilizing width 77 of attachment tabs 72 and can be mounted to an enclosure without debossed tabs utilizing mounting openings 78 of attachment tabs 72. Accordingly, tabbed mounting plate 70 provides for dual mounting capabilities. Attachment tabs 72 are disposed symmetric with respect to a first line of symmetry 80 and are symmetric with respect to a second line of symmetry 82 orthogonal to first line of symmetry 80. Attachment tabs 72 include a leading edge 84 positioned between two tapered edges 86 that extend to two side edges 88.

Figure 7:
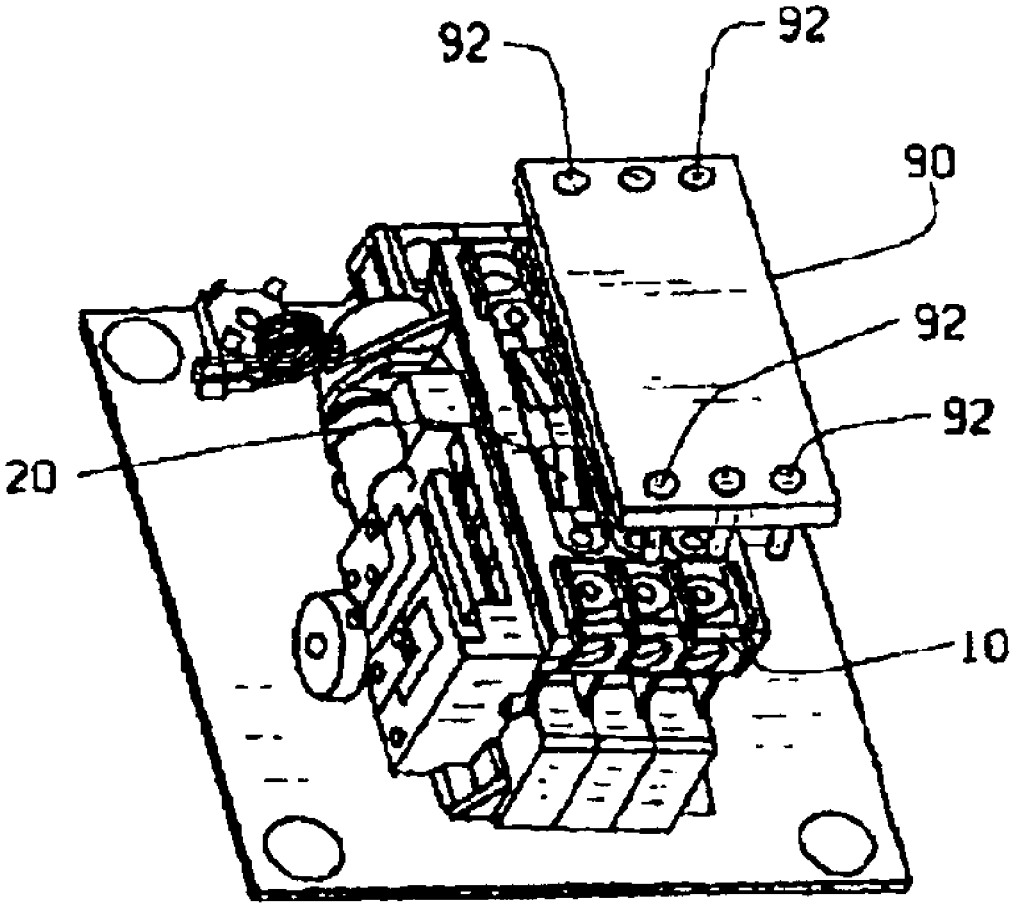
FIG. 7 is a partially exploded view of the automatic transfer switch shown in FIG. 1.

FIG. 7 is a partially exploded view of transfer switch 10 including a removable arc chute cover plate 90 including a plurality of mounting openings 92. Arc chute cover plate 90 is a unitary piece of non-conductive material utilized to cover phase plates 20. In an exemplary embodiment, cover plate is molded from a thermoset plastic i.e., a plastic such that when heat is applied, the plastic softens and then hardens (sets) as the plastic cools wherein the plastic can not be softened again.

During assembly of transfer switch 10, the unitary construction of arc chute cover plate 90 facilitates a reduction in assembly time versus an automatic transfer switch having a plurality of separate cover plates. Transfer switch 10 facilitates a decrease in assembly time by utilizing a pre-assembled auxiliary limit switch assembly, a pre-assembled solenoid side limit switch assembly, and a unitary construction. The limit switches are not adjusted during assembly and installation providing for easy assembly and installation. Additionally, tabbed mounting plate provides for easy mounting of transfer switch 10 to an enclosure facilitating a decrease in installation time.

While the invention has been described in terms of various specific embodiments, those skilled in the art will recognize that the invention can be practiced with modification within the spirit and scope of the claims.

What is claimed is:

1. A method for fabricating an automatic transfer switch, said method comprising the steps of:

providing a main body including a solenoid side; and attaching a solenoid side limit switch assembly including a plurality of coplanar pairs of limit switches and a solenoid side mounting plate to the solenoid side of the main body.

2. A method according to claim 1 further comprising the step of attaching the mounting plate to the main body such that the mounting plate is substantially perpendicular to the limit switches.

3. A method according to claim 1 further comprising attaching an auxiliary side limit switch assembly including an auxiliary side mounting plate and a plurality of auxiliary side limit switches to an auxiliary side of the main body utilizing the auxiliary side mounting plate.

4. A method according to claim 3 further comprising attaching the main body to a mounting plate such that the auxiliary side limit switches are substantially perpendicular to the mounting plate.

5. A method according to claim 1 further comprising attaching an auxiliary side limit switch assembly including an auxiliary side mounting plate and a plurality of auxiliary side limit switches to an auxiliary side of the main body utilizing the auxiliary side mounting plate wherein the auxiliary side limit switches are in fixed relationship with the auxiliary mounting plate.

6. A method according to claim 1 further comprising attaching an auxiliary side limit switch assembly including an auxiliary side mounting plate and a plurality of pairs of coplanar auxiliary side limit switches to an auxiliary side of the main body utilizing the auxiliary side mounting plate wherein at least two pairs of coplanar auxiliary side limit switches are external the main body and at least three pairs of coplanar auxiliary side limit switches are interior the main body.

7. A method for fabricating an automatic transfer switch, said method comprising the steps of:

providing a main body including a solenoid side; and attaching a solenoid side limit switch assembly including a plurality of limit switches and a solenoid side mounting plate to the solenoid side of the main body wherein the limit switches arranged fixedly in coplanar pairs external to the main body.

8. A method for fabricating an automatic transfer switch, said method comprising the steps of:

providing a main body including an auxiliary side; and attaching an auxiliary side limit switch assembly including a plurality of limit switches and an auxiliary side mounting plate to the auxiliary side of the main body.

9. A method according to claim 8 wherein said step of attaching an auxiliary side limit switch assembly further comprises the step of attaching an auxiliary side limit switch assembly including an auxiliary side mounting plate and a plurality of auxiliary side limit switches to an auxiliary side of the main body utilizing the auxiliary side mounting plate wherein the limit switches are in fixed relationship with the auxiliary mounting plate.

10. A method according to claim 8 wherein said step of attaching an auxiliary side limit switch assembly further comprises the step of attaching an auxiliary side limit switch assembly including an auxiliary side mounting plate and a plurality of pairs of coplanar auxiliary side limit switches to an auxiliary side of the main body utilizing the auxiliary side mounting plate wherein at least two pairs of coplanar auxiliary side limit switches are external the main body and at least three pairs of coplanar auxiliary side limit switches are interior the main body.

11. A method according to claim 8 further comprising the step of attaching the main body to a tabbed mounting plate including a plurality of attachment tabs.

12. A method according to claim 8 further comprising the step of attaching the main body to a tabbed mounting plate including a plurality of attachment tabs each including at least one opening substantially centered thereon.

13. An automatic transfer switch comprising:

a main body comprising a solenoid side; and a solenoid side limit switch assembly comprising a plurality of coplanar pairs of limit switches and a solenoid side mounting plate, said solenoid side limit switch assembly mounted to said solenoid side of said main body.

14. A switch according to claim 13 further comprising a mounting plate substantially perpendicular to said solenoid side limit switches attached to said main body.

15. A switch according to claim 13 further comprising a pre-assembled auxiliary side limit switch assembly comprising a auxiliary side mounting plate and a plurality of auxiliary side limit switches, said auxiliary side limit switch assembly attached to an auxiliary side of said main body at said auxiliary side mounting plate.

16. A switch according to claim 15 further comprises a mounting plate attached to said main body, said auxiliary side limit switches substantially perpendicular to said mounting plate.

17. A switch according to claim 16 wherein said auxiliary side limit switches in fixed relationship with said auxiliary side mounting plate.

18. A switch according to claim 16 wherein said auxiliary side limit switches arranged such that at least three pairs of coplanar switches interior said main body and at least two pairs of coplanar switches exterior said main body.

19. An automatic transfer switch comprising:

a main body comprising a solenoid side; and a solenoid side limit switch assembly comprising a plurality of limit switches arranged fixedly in coplanar pairs external to said main body and a solenoid side mounting plate, said solenoid side limit switch assembly mounted to said solenoid side of said main body.

20. An automatic transfer switch comprising:

a main body comprising an auxiliary side; and an auxiliary side limit switch assembly comprising a plurality of limit switches and an auxiliary side mounting plate, said auxiliary side limit switch assembly attached to said auxiliary side of said main body.

21. A switch according to claim 20 wherein said auxiliary side limit switch assembly further comprises a plurality of pairs of coplanar auxiliary side limit switches wherein at least two pairs of coplanar auxiliary side limit switches are external said main body when said auxiliary side limit switch assembly attached to said main body and at least three pairs of coplanar auxiliary side limit switches are interior said main body when said auxiliary side limit switch assembly attached to said main body.

22. A switch according to claim 20 further comprising a tabbed mounting plate including a plurality of attachment tabs attached to said main body.

23. A switch according to claim 22 wherein each said attachment tab comprises at least one opening substantially centered thereon.

* * * * *